United States Patent [19]

Fukuda et al.

[11] Patent Number: 5,066,964

[45] Date of Patent: Nov. 19, 1991

[54] RECORDING HEAD HAVING COOLING MECHANISM THEREFOR

[75] Inventors: Tsuguhiro Fukuda, Yokohama; Hiroshi Nakagomi, Yamato; Seiichirou Karita, Yokohama, all of Japan

[73] Assignee: Canon Kabushiki Kaisha, Tokyo, Japan

[21] Appl. No.: 658,435

[22] Filed: Feb. 20, 1991

Related U.S. Application Data

[63] Continuation of Ser. No. 385,078, Jul. 25, 1989, abandoned.

[30] Foreign Application Priority Data

Jul. 26, 1988 [JP] Japan ..... 63-184691

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,611,219 | 9/1986 | Sugitani et al. | 346/140 |
| 4,712,172 | 12/1987 | Kiyohara | 346/140 X |
| 4,723,129 | 2/1988 | Endo et al. . | |
| 4,723,136 | 2/1988 | Suzumura | 346/140 |
| 4,740,796 | 4/1988 | Endo et al. . | |
| 4,831,390 | 5/1989 | Deshpande | 346/140 |

FOREIGN PATENT DOCUMENTS

| | | |
|---|---|---|
| 56-9429 | 1/1981 | Japan . |
| 44664 | 4/1981 | Japan . |
| 59-123670 | 7/1984 | Japan . |
| 59-138472 | 7/1984 | Japan . |
| 59-138461 | 8/1984 | Japan . |
| 2165855 | 4/1986 | United Kingdom . |

OTHER PUBLICATIONS

Firth R. V., et al., "Cooling a Thermal Print Head", IBM Technical Disclosure Bulletin, vol. 24, No. 12, May 1982; pp. 6323, 6324.

*Primary Examiner*—Joseph W. Hartary

*Attorney, Agent, or Firm*—Fitzpatrick, Cella, Harper & Scinto

[57] ABSTRACT

A liquid-jet recording head comprises an ejection opening for ejecting liquid, a liquid path communicating to the ejection opening and a substrate having an energy-generating element provided in correspondence with the ejection opening. The substrate is combined with a heat-capacity member and the heat accumulated in the substrate is efficiently released through the heat-capacity member.

8 Claims, 4 Drawing Sheets

RECORDING HEAD HAVING COOLING MECHANISM THEREFOR

This application is a continuation of application Ser. No. 07/385,078 filed July 25, 1989, now abandoned.

BACKGROUND OF THE INVENTION

1. Field of the Invention

The present invention relates to a liquid-jet recording head having an ejection-energy-generating element, and more particularly to a recording head which can solve the problem caused by the heat from the ejection-energy-generating element. The present invention also relates to a recording apparatus having the above-mentioned recording head, and more particularly to a recording apparatus which can be miniaturized and simplified.

2. Related Background Art

In known liquid-jet recording apparatuses, liquid is ejected in minute liquid droplets driven by a pressure change in the liquid path caused by the strain of a piezoelectric element, or further, the ejected liquid droplets are deflected by the additional provision of a pair of electrodes. In other proposed apparatuses, liquid is ejected by the driving force of bubbles generated by abrupt heat generation in a heating element in the liquid path. There are further various proposals regarding liquid ejection.

Among these, the types of ejection of a recording liquid by use of heat energy mentioned last, as disclosed in U.S. Pat. No. 4,723,129 and U.S. Pat. No. 4,740,796, is regarded as being particularly useful in liquid-jet recording apparatuses because the method enables the high-density arrangement of the ejection openings as well as high-speed recording.

In such recording methods, the change of temperature of the recording liquid caused by the drive of the ejection-energy generating elements or by the heat transferred from the drive-signal transmitting circuit can sometimes be a serious factor. The reason is that a recording liquid will change its properties, such as surface tension and viscosity, depending on the temperature, and such a change will affect the ejected quantity, the feeding rate, etc. of the recording liquid. The temperature rise of the recording liquid is remarkable when a heat-generating element is employed. This temperature rise depends on the temperature rise of the substrate of the recording head where the heat-generating element is provided. For controlling the temperature of recording liquids, systems have been employed in which the temperature rise of the substrate (hereinafter referred to as "a heat-generating substrate") is prevented.

One of the systems, for example, is based on spontaneous cooling (air-cooling) in which a heat-generating substrate is attached onto a heat-conductive substrate so that the superfluous portion of the heat energy generated by the heat-generating substrate may be released through the heat-conductive substrate to the surrounding atmosphere.

There is literature regarding heat problems. Japanese Patent Publication No. Sho-56-9429 (1981) discloses a Peltier element, provided in addition to a heat-energy generating element, to allow bubbles to constrict after their formation by nuclear boiling, thus extinguishing the bubbles. U.S. Pat. No. 4,723,129 discloses use of a heat energy generating element simultaneously exhibiting a Peltier effect also. These elements, however, are directed to bubbles per se, and do not based directly on the technical idea regarding a heat-generating substrate. Japanese Patent Laid-open Application No. Sho-59-138472 (1984) discloses a perforation construction of a substrate for the supply of liquid from the back face to its front face adjacent to a common liquid chamber for the purpose of stable liquid supply from the common chamber to a plurality of liquid paths. This publication, however, recognizes nothing about the problems caused by heat. The reason is clear from the fact that the construction disclosed by the Patent Publication includes a very small contact region area between the liquid supply paths and the substrate so that the thermal variation is not influential.

Anyway, a recording head of a liquid-jet recording apparatus employing liquid ejection energy, and in particular, employing heat energy, involves the problem that, when high-density recording such as solid printing is practiced particularly at a high velocity by a high-frequency drive, the temperature of the recording head rises to cause abnormal bubbling, resulting in difficulty in the formation of normal liquid droplets, and deterioration of the quality of recording caused by a variation of dot diameter at a temperature higher than a certain level $T_1$.

To meet the problems, the recording is simply stopped when the temperature of the recording head rises to a certain temperature $T_2$ which is lower than temperature $T_1$ until the temperature of the head falls, or otherwise the liquid temperature is lowered by conducting preliminary ejection as disclosed in British Patent No. 2,165,855, and thereafter the recording is restarted. However, such interruption of recording for a long time offsets the advantage of high speed recording.

The above-mentioned phenomenon of temperature rise is especially remarkable in recording heads made of a low-thermal-conductivity material such as a plastic. A construction employing a high-thermal-conductivity material for cooling is not suitable for miniaturization of the head because of the required large volume of the heat radiation substrate to secure sufficient heat capacity.

On the other hand, air-cooling types of heads involve problems that the recording is liable to be affected by the environment and that the temperature cannot easily be controlled stably and effectively. In this type of cooling, heat is accumulated increasingly with the lapse of time, causing a temperature rise of the liquid, a change of ejected liquid droplet diameter and ejecting rate, etc. with time, and non-uniformity of recording concentration from the beginning to the end of the recording, which may not sufficiently satisfy the need for a stable recording of high quality.

SUMMARY OF THE INVENTION

An object of the invention is to provide a liquid-jet recording head and a recording apparatus using a head which has solved the aforementioned problems of the disadvantageous enlargement of the apparatus and an increase in of heat accumulation resulting from a low heat radiation coefficient.

Another object of the present invention is to provide a liquid-jet recording head and a recording apparatus using the head which enable high speed recording of a high quality image independently of the length of time of recording.

A further object of the present invention is to provide a liquid-jet recording head and a practically miniaturized and inexpensive recording apparatus using a head which enables the thermal change rate of the liquid jet recording head to be reduced without special driving, without intermittance of recording and without enlargement of the recording apparatus.

A still further object of the present invention is to provide a liquid-jet recording head which comprises a liquid-path-forming member having a heat capacity sufficient for adjusting substantially the temperature of the substrate at the side opposite to a liquid path for the ejection liquid in relation to a substrate having an ejection-energy-generating element.

According to an aspect of the present invention, there is provided a liquid-jet recording head comprising an ejection opening for ejecting liquid; a first liquid path communicating with the ejection opening; and a substrate having an energy-generating element provided in correspondence with the ejection opening; the substrate being combined with a heat-capacity member for forming a second liquid path for supplying the liquid to the first liquid path.

According to another aspect of the present invention, there is provided a recording apparatus comprising a liquid-jet recording head comprising an ejection opening for ejecting liquid; a first liquid path communicating with the ejection opening; and a substrate having an energy-generating element provided in correspondence with the ejection opening; the substrate being combined with a heat-capacity member for forming a second liquid path for supplying the liquid to the first liquid path, the apparatus further comprising a carriage for carrying the recording head, a driving motor, for driving the carriage, and a control means for supplying a driving signal at high speed for generating ejection energy at the recording head.

According to a further aspect of the present invention, there is provided a liquid-jet recording head, comprising a substrate; a plurality of electrothermal energy transducers provided on the substrate in a predetermined arrangement; first liquid paths provided on the substrate in correspondence respectively with each of the electrothermal energy transducers; a heat-conductive liquid-path-forming member for forming a second liquid path in combination with the substrate and being in contact with the substrate at the side opposite to the first liquid paths in relation to the substrate, the liquid paths formed of the first liquid paths and the second liquid path being bent.

DETAILED DESCRIPTION OF THE PREFERRED EMBODIMENT

In a typical preferred embodiment of the present invention, briefly, the heat accumulated in the substrate having an ejection-energy-generating means is efficiently released through a heat-capacity member provided at least in contact with a surface of the substrate, and the rise of the substrate temperature is suppressed by the flow of the liquid through the liquid path formed by the heat-capacity member and the substrate to promote heat exchange.

In consideration of the high heat generation in the central portion of the ejection-energy-generating element arrangement, heat distribution can advantageously made uniform by forming a liquid path so as to introduce the liquid first to the center region of the arrangement and then toward the both ends of the arrangement.

The present invention is explained in detail based on the drawings.

Figure 2:
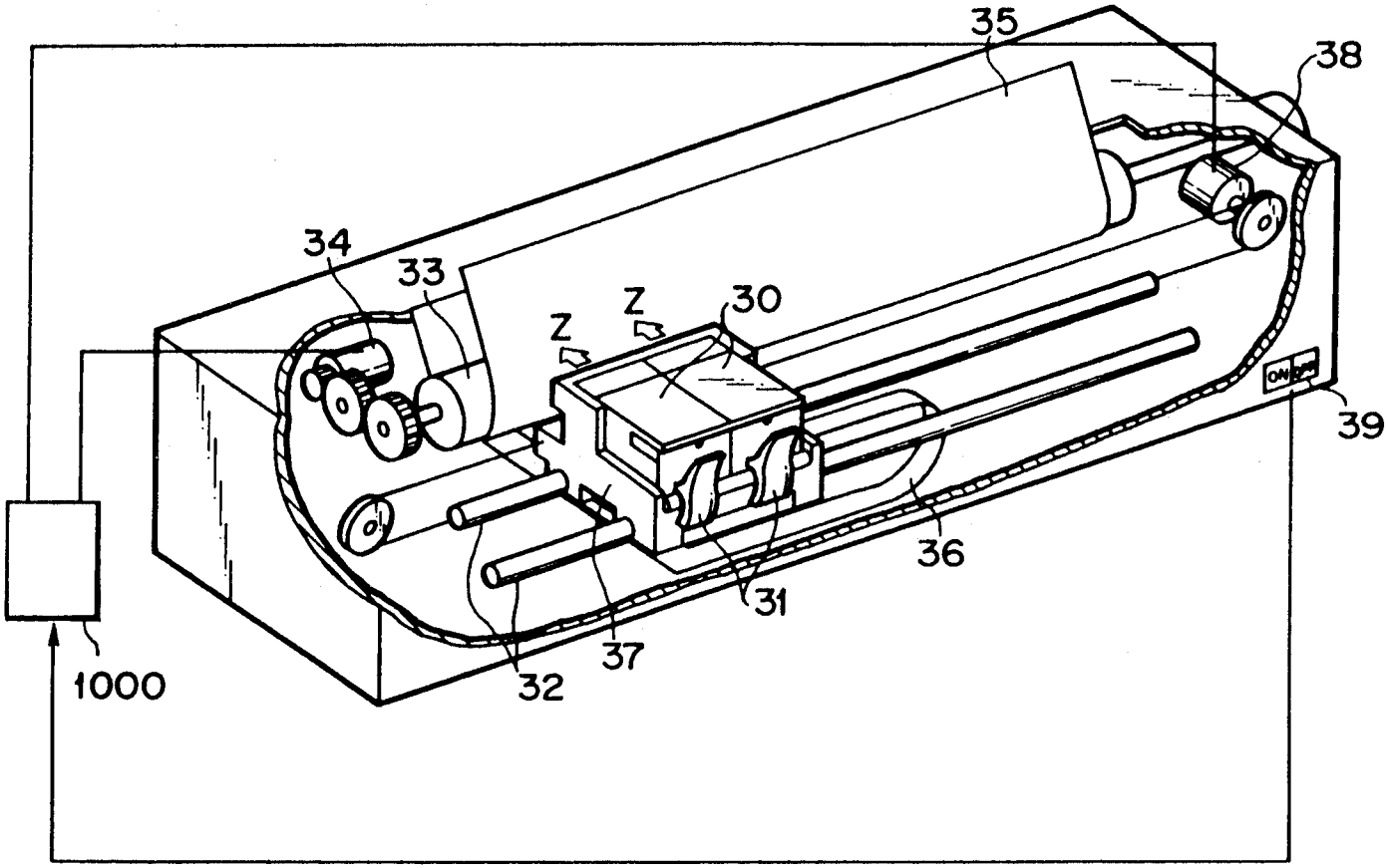
FIG. 2 is a perspective view of a liquid-jet recording apparatus provided with the recording head of FIG. 1.

Referring firstly to FIG. 2, an example of a liquid-jet recording apparatus is described which is provided with the recording head of the present invention.

Recording heads 30 which eject respectively recording liquid of different colors are fixed to a carriage 31 by a pressing members 37. The recording heads 30 in FIG. 2 are the ones shown in FIG. 1 and store recording liquid therein. The carriage 37 provided with the recording heads 30 moves in a reciprocating manner along a guide member 32 by the driving force from a driving motor 38. Liquid is ejected in the z direction to a recording medium 35, while the carriage is moving to conduct recording. A platen 33 is rotated by a motor 34, to deliver the recording medium 35.

A flexible wiring 36 supplies electrical signals for ejecting the recording liquid in the z direction through a connecting member provided on the carriage 37.

A control means 1000 controls the above-mentioned constitution of the devices to conduct recording at a predetermined time. In particular the control means supplies drive signals to the aforementioned electrothermal energy transducer at a high speed in correspondence with the recording signals. The action of the control means 1000 is controlled by a main switch 39 which switches on and off the apparatus. The apparatus in this example achieves high speed recording without employing a momentary stop mode and a conventional recovery means and operating mode therefor for avoiding a loss of time.

Figure 1A:
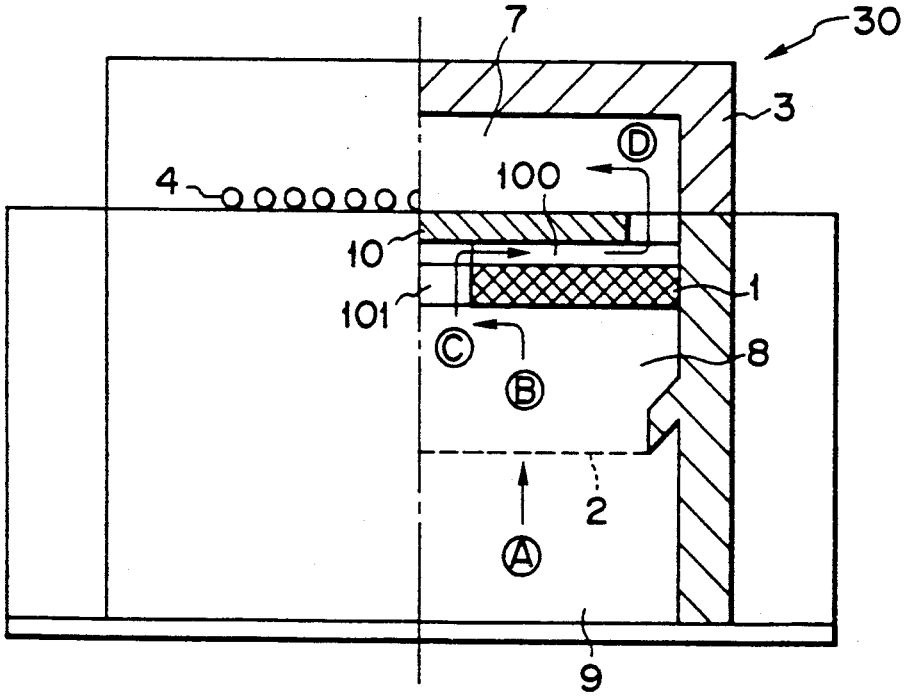
FIG. 1A, FIG. 1B, and FIG. 1C show respectively a partial sectional view from the ejection opening side, a sectional side view perpendicular to the liquid paths directing to the ejection openings, and a plan view of the substrate, of a recording head of the present invention.
Figure 1B:
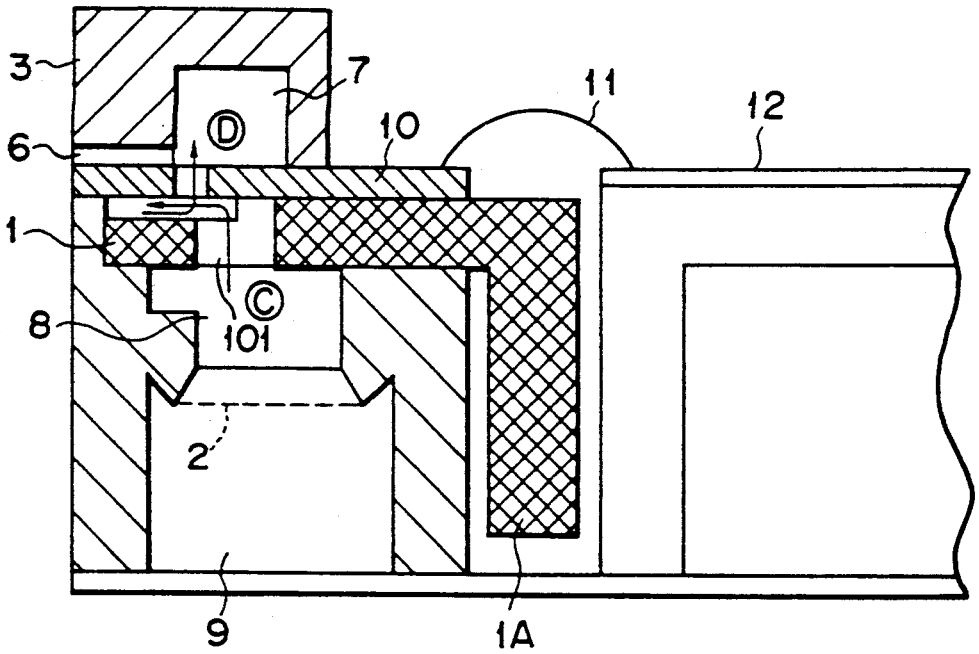
Figure 1C:
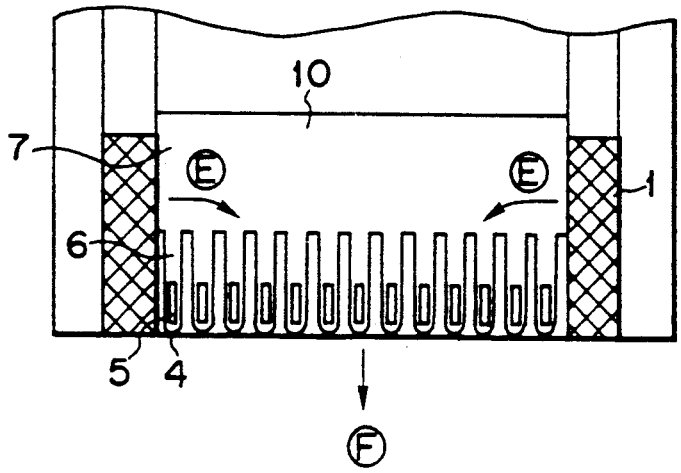

FIG. 1A, FIG. 1B, and FIG. 1C show respectively a partial sectional view from the ejection opening side, a sectional side view perpendicular to the liquid paths directed to the ejection openings, and a plan view of the substrate, of a recording head of embodiment of the present invention.

In the FIGS. 1A to 1C, a heat-capacity member (or a cooling member) 1 of the present invention is provided in contact with the substrate 10. In this example, the heat-capacity member is formed from a resin with a metal dispersed therein which has larger heat capacity than the substrate and exhibits a heat accumulation effect. The numeral 2 denotes a filter for removing dust from the recording liquid; 3 denotes a cover plate; 4 denotes an ejection opening or an orifice; 7 denotes a common liquid chamber. The numeral 6 denotes a linear liquid path which introduces the recording liquid from the common liquid chamber to the ejection opening 4. A plurality of the liquid paths are arranged in at a predetermined spacing, and are respectively provided with a heat-generating element 5 as an electrothermal energy transducer.

The numerals 8 and 9 denote recording liquid tanks separated by a filter 2; 10 denotes a heat-generating substrate; 11 denotes a wire bonding for connecting electrically the heat-generating substrate 10 with a lead frame 12.

In this example, the heat-capacity member 1 is a hollowed member, and forms a liquid path 100 in combination with the substrate. The liquid path communicates with a tank 8 to a common liquid chamber 7 through a liquid path 101 directing from the tank 8 to the substrate 10, and is perpendicular to the ejection direction of the liquid droplets and parallel to the heat-generating substrate 10. The recording liquid flows along the arrow marks from (A) to (D) in the figures. More specifically, the recording liquid flows through the filter 2 with dust removed [(A)] and reaches the back face of the heat-capacity member 1 through a liquid path provided under the heat-capacity member [(B) and (C)], cooling the heat-capacity member by heat exchange. The recording liquid subsequently passes the liquid path 101 to the substrate 10 to cool the substrate 10 at the central region thereof, then flowing in the liquid path 100 in a direction perpendicular to the ejection of the flying liquid droplets and parallel to the heat-generating substrate to exchange heat with the substrate [(C), (D)]. The recording liquid enters the common liquid chamber 7 located on the heat-generating substrate 10 from both end regions of the arrangement of the ejection-energy-generating elements [D], and then flows into each of the liquid paths 6 [(E)] receiving heat energy from the heat generating element 5 to be ejected from ejection opening 4 by generation of bubbles [(F)], to conduct recording on the recording medium.

The recording liquid is made to be ejected from the apparatus on receiving heat from the heat-generating substrate. The higher the recording density, the more the quantity of the ejected liquid, and the higher the aforementioned cooling efficiency, so that an abrupt temperature rise of the heat-generating substrate is unlikely to occur even with high-density recording.

As described above, the heat-capacity member 1 of the present invention is in contact with the heat-generating substrate 10, serving to receive the heat that is accumulated in the heat-generating substrate 10. Additionally, the liquid paths of the recording liquid provided in the heat-capacity member enable the effective heat exchange with the recording liquid.

The movement of the recording liquid in the direction intersecting the arrangement of the energy-generating elements is advantageous in uniformization of temperature distribution throughout the substrate.

The heat capacity of the heat-capacity member 1 is preferably larger for receiving a larger amount of heat accumulated in the heat-generating substrate. The heat capacity of not less than 0.1 J/K is preferable. With the heat capacity of less than 0.1 J/K, there may arise troubles such that the heat-capacity member cannot receive sufficient heat from the heat-generating substrate, or the temperature of the heat-capacity member rises abruptly to cause an abrupt temperature rise of the recording liquid. On the other hand, although the upper limit of the heat capacity is not specified, the value of not more than 10 K/J is preferable for miniaturizing of recording heads.

The contact area between the heat-capacity member 1 and the heat-generating substrate 10 is preferably not less than 40% of the back face of the heat-generating substrate since a larger area is more effective in heat transfer. In consideration of formation of the liquid paths of the recording liquid, the upper limit is preferably 95% for securing the liquid path from (C) to (D).

The surface roughness of the heat-capacity member is preferably not higher than 25 $\mu$mRs(25S) in terms of center-line average roughness, and the surface undulation is preferably not higher than 40 $\mu m W_{CA}$ in terms of profile irregularity (three-wave center line undulation).

The material for constituting the heat-capacity member may be a resin or a ceramic if it meets the requirement mentioned below, and is particularly preferably a metal having a high thermal conductivity such as copper, aluminum, bronze, beryllium, nickel, platinum, stainless steel, and steel. The thermal conductivity thereof is preferably not less than 5 J/m.S.K. If the thermal conductivity is less than 5 J/m.S.K, the heat received from the heat-generating substrate cannot be transferred to the recording liquid, not suppressing the temperature rise of the heat-generating substrate.

A larger contact area between the recording liquid and the liquid path provided in the heat-capacity member is preferable for a higher heat exchange rate, and a contact area of not less than 20 $mm^2$ is preferable. An area of less than 20 $mm^2$ may cause insufficient liquid paths, hindering the flow of the recording liquid, and the attachment of bubbles or dust.

Naturally, the present invention is not limited to the above constitution, but includes various modifications.

Figure 3:
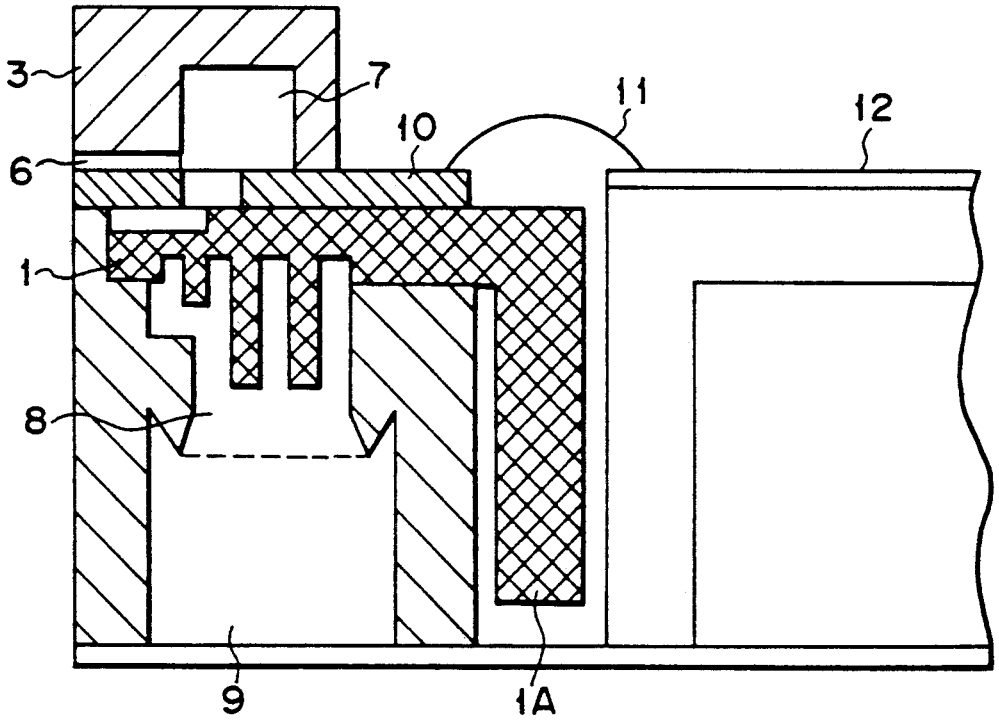
FIG. 3 is a partial sectional view of another embodiment of the recording head of the present invention.

For example, the heat-capacity member and the heat-generating substrate 10 (or the part thereof being integrated) is constructed as shown in FIG. 3 to take a stepped or finned structure so as to obtain a larger contact area with the recording liquid to exchange heat more effectively. Otherwise, a portion of the heat-capacity member 1 may be extended out of the liquid and provide a fin 1A to release the heat into the atmosphere.

The liquid path formed in the heat-capacity member 1 may be in any shape inasmuch as it enables effective heat exchange.

The above description relates to the application of the present invention to a serial type of recording heads provided on a carriage. However, the present invention can naturally applicable with effectiveness and ease to full-line type of recording heads in which ejection openings are arranged over the full width of a recording medium.

As described above, according to the examples, the rise of the temperature of the heat-capacity member itself can effectively be prevented by transferring the energy generated in a heat-generating element and accumulated in the heat-generating substrate into a heat-capacity member having a large heat capacity, and by subsequently releasing the heat to the recording liquid flowing in a liquid path formed in the heat-capacity member. As the result, the liquid can be ejected stably independently of recording speed and recording density, so that high-speed high-density recording can be made consistently and effectively.

Recording apparatuses provided with the above-described liquid-jet recording heads are satisfactory indeed in practical application since the apparatuses require no other complicated mechanism, are simple in construction, and yet are capable of high recording.

The present invention shows excellent effects particularly in recording heads and recording apparatus employing bubble jet systems among ink jet recording systems.

The typical constructions and the principles thereof are disclosed, for example, by U.S. Pat. No. 4,723,129, and U.S. Pat. No. 4,740,796. The system of the present invention is applicable both to an on-demand type and to a continuous type. This system is particularly effective with an on-demand type since, in the system, heat energy is generated in an electrothermal transducer by applying a driving signal to the transducer located in correspondence with a sheet or a liquid path holding a liquid (or ink) to give rapid temperature rise exceeding the nuclear boiling temperature corresponding to recording information and to give film boiling on the heating surface of the recording head, forming bubbles in one-to-one correspondence with the driving signal. Liquid (or ink) is ejected by the growth and constriction of the bubble through the ejection opening to form at least one droplet. Pulse type driving signals enables instantaneous and suitable growth and constriction of the bubble, achieving excellent responsiveness of ejection of liquid (or ink), and is preferable. Suitable driving signals of the pulse type is described in U.S. Pat. No. 4,463,359 and U.S. Pat. No. 4,345,262. Additionally, more excellent recording is realized if the conditions described in U.S. Pat. No. 4,313,124 regarding the temperature rise rate of the heat action surface mentioned above are effected.

The present invention covers the constitution of a recording head such as a combination of an ejection opening, a liquid path, and an electrothermal transducer (a linear liquid path or a rectangular liquid path) disclosed in the above cited patent specifications, and also a constitution having a heat action portion located in a bent region disclosed in U.S. Pat. No. 4,558,333 and U.S. Pat. No. 4,459,600. Further, the present invention is applicable effectively to constructions employing a common slit for ejection opening for electrothermal transducers disclosed by Japanese Patent Laid-open Application No. Sho-59-123670, and constructions having openings for absorbing a pressure wave in correspondence with the ejection openings disclosed in Japanese Patent Laid-open Application No. Sho-59-138461.

We claim:

1. A liquid-jet recording head comprising:
an ejection opening for ejecting liquid;
a first liquid path communicating with the ejection opening;
a substrate having an electrothermal energy transducer for generating heat energy provided in correspondence with the ejection opening; and
a heat-capacity member, wherein said substrate and said heat-capacity member together form a second liquid path of predetermined length along said substrate for supplying the liquid to the first liquid path, wherein the second liquid path permits liquid to be held in and to flow therethrough.

2. The liquid-jet recording head of claim 1, wherein said heat-capacity member is made from a metal having a high heat conductivity.

3. A liquid-jet recording head according to claim 1, wherein the area of the second liquid path in contact with said substrate is at least 20 cubic millimeters.

4. A recording apparatus comprising: a liquid-jet recording head comprising:
an ejection opening for ejecting liquid;
a first liquid path communicating with the ejection opening;
a substrate having an energy-generating element provided in correspondence with the ejection opening; and
a heat-capacity member, wherein said substrate and said heat-capacity member together form a second liquid path for supplying the liquid to the first liquid path;
a carriage for carrying said recording head;
a driving motor for driving said carriage; and
control means for supplying a driving signal at a high speed for generating ejection energy at said recording head.

5. A liquid-jet recording head, comprising:
a substrate;
a plurality of electrothermal energy transducers provided on said substrate in a predetermined arrangement;
a plurality of first liquid paths provided on said substrate in correspondence, respectively, with each of said electrothermal energy transducers;
a heat-conductive liquid-path-forming member for forming a second liquid path, of predetermined length along said substrate and permitting the holding of and the flow of liquid therethrough, in combination with said substrate and being in contact with said substrate at the side opposite to the plurality of first liquid paths in relation to said substrate, wherein the liquid supplying paths formed of the plurality of first liquid paths and the second liquid path are bent.

6. The liquid-jet recording head of claim 5, wherein the second liquid path is formed parallel to the plane of the arrangement of said electrothermal energy transducers and in a direction crossing said electrothermal energy transducers.

7. The liquid-jet recording head of claim 6, wherein the plurality of first liquid supplying paths enter the second liquid path made by the liquid-path-forming member leading to the middle portion of the arrangement of said electrothermal energy transducers and reaches the both end sides of the arrangement.

8. A liquid-jet recording head according to claim 5, wherein the area of the second liquid path in contact with said substrate is at least 20 cubic millimeters.

* * * * *

UNITED STATES PATENT AND TRADEMARK OFFICE

CERTIFICATE OF CORRECTION

PATENT NO. : 5,066,964

DATED : November 19, 1991

INVENTOR(S) : TSUGUHIRO FUKUDA ET AL.

It is certified that error appears in the above-identified patent and that said Letters Patent is hereby corrected as shown below:

COLUMN 2

Line 2, "do" should read --are--.
Line 62, "of" should be deleted.

COLUMN 3

Line 56, "directing" should read --directed--.

COLUMN 4

Line 9, "can" should read --can be--.
Line 20, "31" should read --37--.
Line 21, "a pressing members 37." should read --pressing members 31.--.
Line 49, "of embodiment" should read --of an embodiment--.
Line 63, "in" should be deleted.

COLUMN 5

Line 8, "directing" should read --directed--.
Line 20, "flowing" should read --flows--.

COLUMN 6

Line 43, "can" should read --can be--.

UNITED STATES PATENT AND TRADEMARK OFFICE

CERTIFICATE OF CORRECTION

PATENT NO. : 5,066,964

DATED : November 19, 1991

INVENTOR(S) : TSUGUHIRO FUKUDA ET AL.

It is certified that error appears in the above-identified patent and that said Letters Patent is hereby corrected as shown below:

COLUMN 8

Lines 7-23 should read:

--4. A recording apparatus comprising:

a liquid-jet recording head comprising:

an ejection opening for ejecting liquid;

a first liquid path communicating with the ejection opening;

a substrate having an energy-generating element provided in correspondence with the ejection opening; and a heat-capacity member, wherein said substrate and said heat-capacity member together form a second liquid path for supplying the liquid to the first liquid path;

a carriage for carrying said recording head;

a driving motor for driving said carriage; and control means for supplying a driving signal at a high speed for generating ejection energy at said recording head.--.

Signed and Sealed this

Twenty-third Day of November, 1993

Bruce Lehman

*Attest:*

BRUCE LEHMAN

*Attesting Officer*

*Commissioner of Patents and Trademarks*